US008432286B2

(12) United States Patent
Kolton et al.

(10) Patent No.: US 8,432,286 B2
(45) **Date of Patent: *Apr. 30, 2013**

(54) ELECTRONIC TAG HOLDER FOR CAPPED BOTTLE NECK

(75) Inventors: Chester Kolton, Westfield, NJ (US); Michael Norman, East Brunswick, NJ (US); Alex Tetiyevsky, Springfield, NJ (US)

(73) Assignee: B&G International, Inc., Newark, NJ (US)

( * ) Notice: Subject to any disclaimer, the term of this patent is extended or adjusted under 35 U.S.C. 154(b) by 247 days.

This patent is subject to a terminal disclaimer.

(21) Appl. No.: 12/787,925

(22) Filed: May 26, 2010

(65) Prior Publication Data

US 2010/0253524 A1 Oct. 7, 2010

Related U.S. Application Data

(63) Continuation-in-part of application No. 12/625,052, filed on Nov. 24, 2009.

(60) Provisional application No. 61/119,484, filed on Dec. 3, 2008.

(51) Int. Cl.
*G08B 13/14* (2006.01)

(52) U.S. Cl.
USPC ..... 340/572.9; 340/572.1; 340/10.1

(58) Field of Classification Search ..... None
See application file for complete search history.

(56) References Cited

U.S. PATENT DOCUMENTS

| | | | |
|---|---|---|---|
| 3,685,676 | A | 8/1972 | Gach et al. |
| 3,756,444 | A | 9/1973 | McIntosh |
| 3,853,236 | A | 12/1974 | Ostrowsky |
| 3,902,339 | A | 9/1975 | Carley et al. |
| 3,915,326 | A | 10/1975 | Hrubesky |
| 4,018,640 | A | 4/1977 | Amberg |
| 4,089,463 | A | 5/1978 | Babiol |
| 4,176,756 | A | 12/1979 | Gellman |
| 4,405,161 | A | 9/1983 | Young et al. |
| 4,457,445 | A | 7/1984 | Hanks et al. |
| 4,471,982 | A | 9/1984 | Nielsen, Jr. |
| 4,674,778 | A | 6/1987 | Ruiz |
| 4,729,487 | A | 3/1988 | Wright |
| 4,813,564 | A | 3/1989 | Cooper et al. |
| 5,230,541 | A | 7/1993 | Nowak |
| 5,602,530 | A | 2/1997 | Holmgren |
| 5,667,085 | A | 9/1997 | Ogden et al. |
| 6,137,413 | A | 10/2000 | Ryan, Jr. |

(Continued)

FOREIGN PATENT DOCUMENTS

| | | | |
|---|---|---|---|
| GB | 2465892 | A | 6/2010 |
| WO | 2007/086984 | A1 | 8/2007 |
| WO | 2008/075310 | | 6/2008 |

*Primary Examiner* — Travis Hunnings
(74) *Attorney, Agent, or Firm* — Hoffman & Baron, LLP

(57) ABSTRACT

A housing assembly supports an electronic tag to the extending neck of a bottle. The housing assembly includes a housing for accommodating the electronic tag. The housing has a bearing surface for engagement with the extending neck of the bottle. A strap is coupled to the housing about the bottle neck. The strap has a bearing surface for engagement with the extending neck. The bearing surface of at least one of the strap and the housing is tapered to match the taper of the extending neck of the bottle.

16 Claims, 5 Drawing Sheets

U.S. PATENT DOCUMENTS

| | | | | |
|---|---|---|---|---|
| 6,254,139 | B1 | 7/2001 | Fresnel | |
| 6,342,838 | B1 | 1/2002 | Kolton et al. | |
| 6,604,643 | B1 | 8/2003 | Michael et al. | |
| 6,696,955 | B2 | 2/2004 | Kolton et al. | |
| 6,831,552 | B2 | 12/2004 | Lin | |
| D506,694 | S | 6/2005 | Corney | |
| 7,048,179 | B2 | 5/2006 | Claessens et al. | |
| 7,061,382 | B2 | 6/2006 | Claessens et al. | |
| 7,394,383 | B2 | 7/2008 | Hager et al. | |
| 2006/0151414 | A1 | 7/2006 | Mullen | |
| 2007/0062903 | A1 | 3/2007 | Norman et al. | |
| 2007/0285243 | A1 | 12/2007 | Feibelman | |
| 2008/0030334 | A1* | 2/2008 | Marsilio et al. | 340/572.1 |
| 2008/0048868 | A1 | 2/2008 | Chua et al. | |
| 2008/0230509 | A1* | 9/2008 | Koo et al. | 215/386 |
| 2008/0289372 | A1 | 11/2008 | Rendon et al. | |
| 2010/0085191 | A1* | 4/2010 | Kolton et al. | 340/572.8 |
| 2010/0133224 | A1 | 6/2010 | Kolton et al. | |
| 2010/0253524 | A1* | 10/2010 | Kolton et al. | 340/572.9 |
| 2011/0074583 | A1* | 3/2011 | Kolton et al. | 340/572.8 |

* cited by examiner

ELECTRONIC TAG HOLDER FOR CAPPED BOTTLE NECK

CROSS-REFERENCE TO RELATED APPLICATION

This application is a continuation in part of Ser. No. 12/625,052, filed Nov. 24, 2009, which claims priority to U.S. Provisional Patent Application No. 61/119,484, filed on Dec. 3, 2008, which is incorporated herein by reference.

FIELD OF THE INVENTION

The present invention relates generally to a holder for an electronic tag. More particularly, the present invention relates to a holder for an electronic tag which may be applied to a capped bottle neck.

BACKGROUND OF THE INVENTION

Electronic tags are used for a wide variety of purposes, including the tracking of items which contain the tag, inventory control, security, and also provide information which may be electronically readable.

These tags or markers may include radio frequency identification (RFID) tags or electronic article surveillance (EAS) tags. EAS tags may be used to provide theft deterrence. These tags are used in combination with an alarm system which monitors undesired movement of the article containing the EAS tag.

Various housings for such tags have been developed which accommodate the electronic tag and which attach the tags to the desired article. It is desired that the tags be securely supported to the article in such a manner where it remains with the article until the time of purchase.

With respect to some articles, such as beverage bottles, various housings have been developed to secure the tag to different locations on the bottle. One troublesome location to apply tags is to the outside surface of a tapered neck of the bottle. While this is a desirous location to apply the tag, it is difficult to attach the tag and maintain the tag on the neck.

It is therefore desirable to provide a tag housing which may be secured about the neck of a bottle.

SUMMARY OF THE INVENTION

A housing assembly is provided for supporting an electronic tag to an extending neck of a bottle. The housing assembly includes a housing for accommodating the electronic tag. The housing includes a bearing surface for engagement with the extending neck of a bottle. A strap is lockingly coupled to the housing about the bottle neck. The strap has a bearing surface for engagement with the extending neck. The bearing surface of at least one of the strap and the housing is tapered to match the taper of the extending neck of the bottle.

DETAILED DESCRIPTION OF THE INVENTION

The present invention provides a housing assembly for supporting electronic tag on the neck of a bottle.

Figure 1:
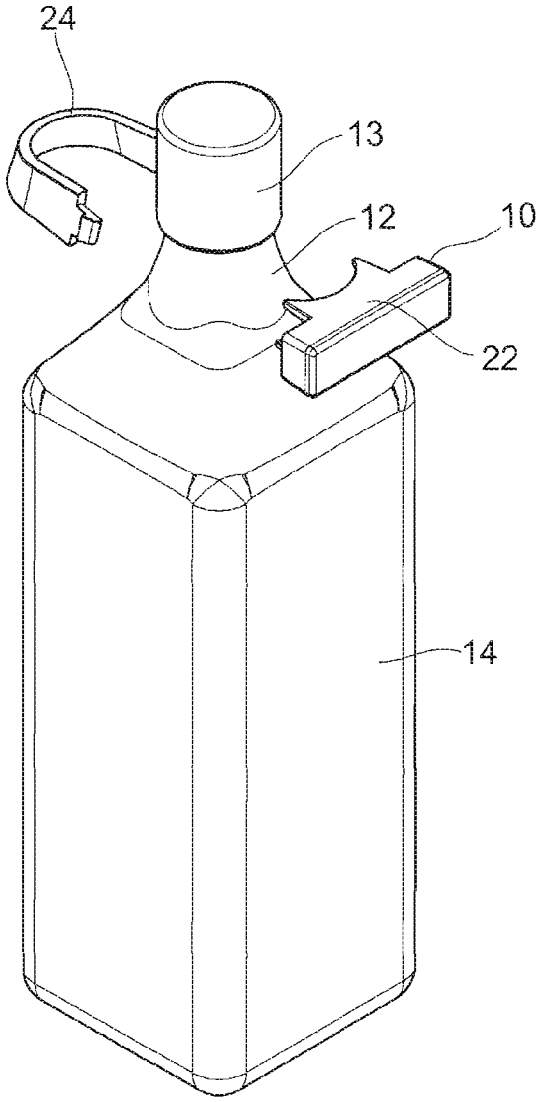
FIGS. 1 and 2 are perspective views of the tag housing assembly of the present invention attached to the extending neck of a bottle.
Figure 2:
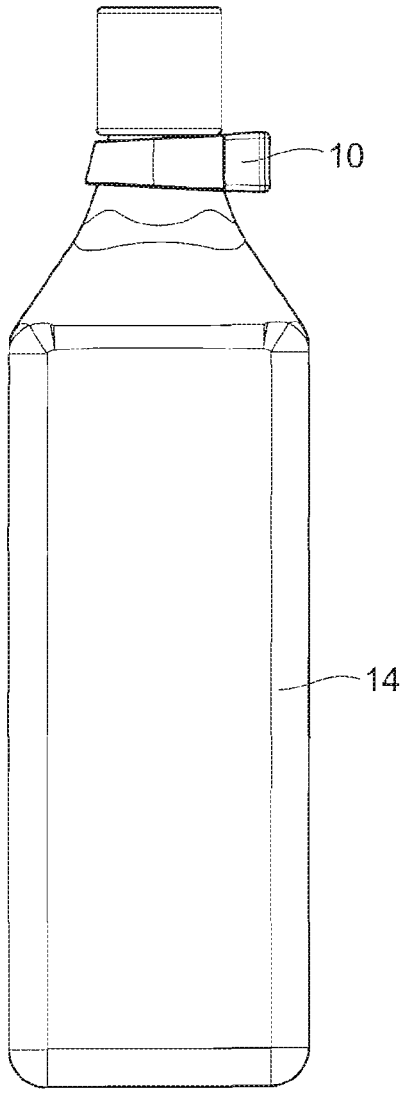
Figure 3:
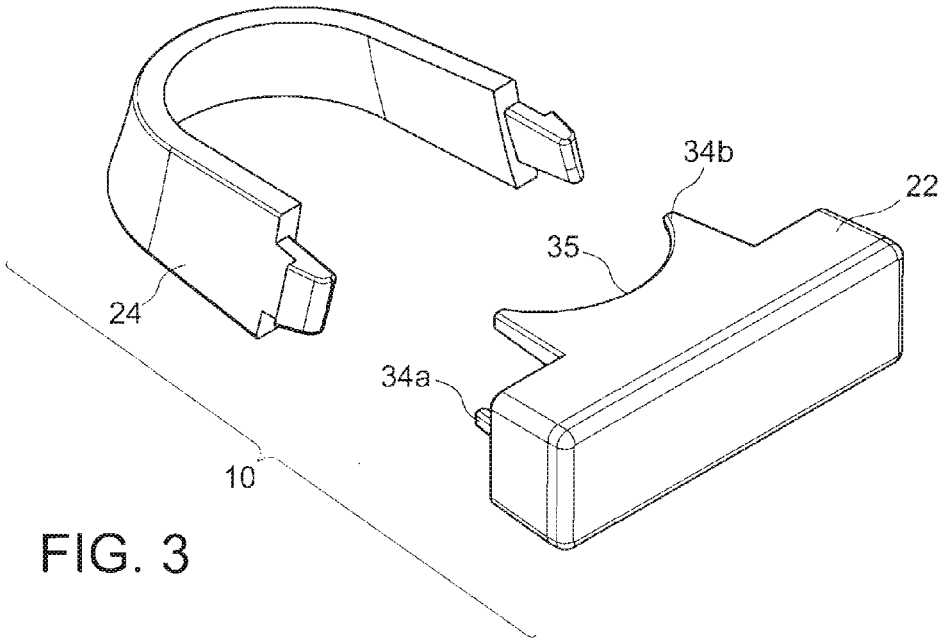
FIG. 3 is an exploded view of the tag housing assembly of the present invention.

Referring to FIGS. 1 and 2, a tag housing assembly 10 may be supported on the neck 12 of a bottle 14. The tag housing assembly 10 includes a housing 22 and a strap 24 which is attachable to the housing 22 about the elongate extending neck 12 of bottle 14. Housing 22 as well as strap 24 may be formed of a suitable plastic material such as high impact polystyrene.

Figure 4:
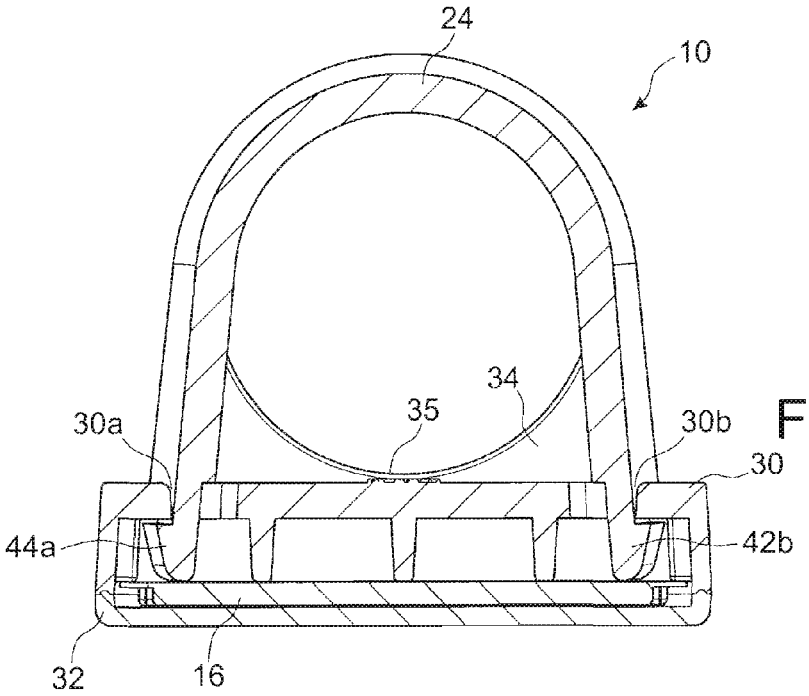
FIG. 4 is a sectional showing of the assembled tag housing assembly of FIG. 3.
Figure 5:
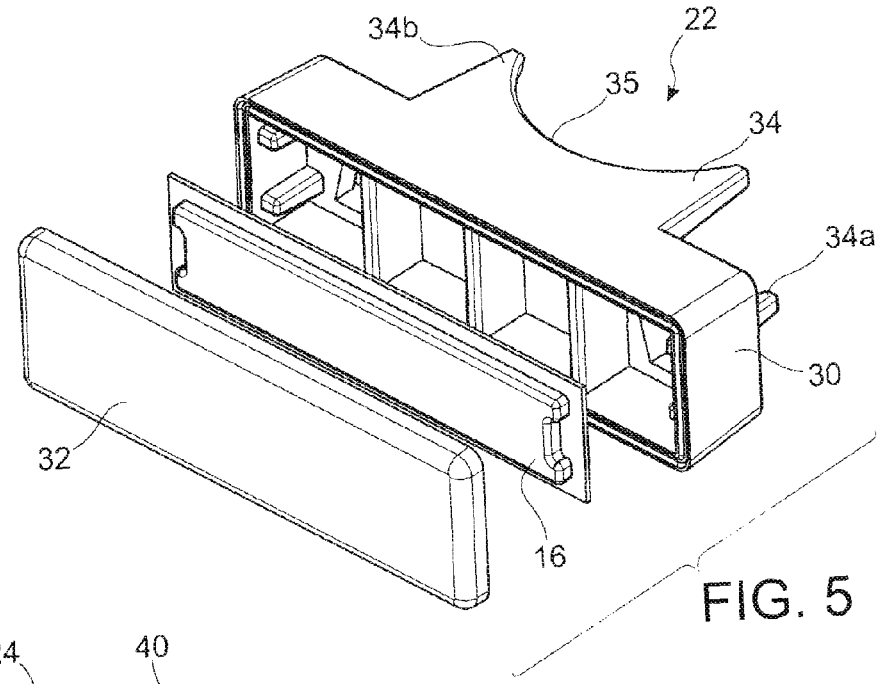
FIG. 5 is an exploded view of the base of the tag housing assembly of FIG. 3.

As shown in FIGS. 4 and 5, the housing assembly 10 supports an electronic tag 16 which may be a radio frequency identification (RFID) tag or an electronic article security tag (EAS) tag or any similar electronic tag. The present invention is designed to attach the electronic tag 16 to bottle 14 having a removable cap 20 (FIGS. 1 and 2) which prevents the tag housing 10 from being removed from the neck 12 of the bottle.

Referring now to FIG. 5, the housing 22 of the housing assembly 10 of the present invention is shown. Housing 22 includes a base 30 and a cover 32 which is ultrasonically welded to the base. The base and cover support therebetween the electronic tag 16. The base includes an extending semicircular neck engagement portion 34 which includes a pair of identically formed spaced apart arcuate extensions 34*a* and 34*b* which are designed for engagement with the neck of the bottle. The extensions 34*a* and 34*b* define an arcuate nest 35 which seats against the bottle neck. Housing base 30 further includes a pair of spaced apart recesses 30*a* and 30*b*. The recesses are designed for accommodating latches of strap 24 as will be described hereinbelow.

Figure 6:
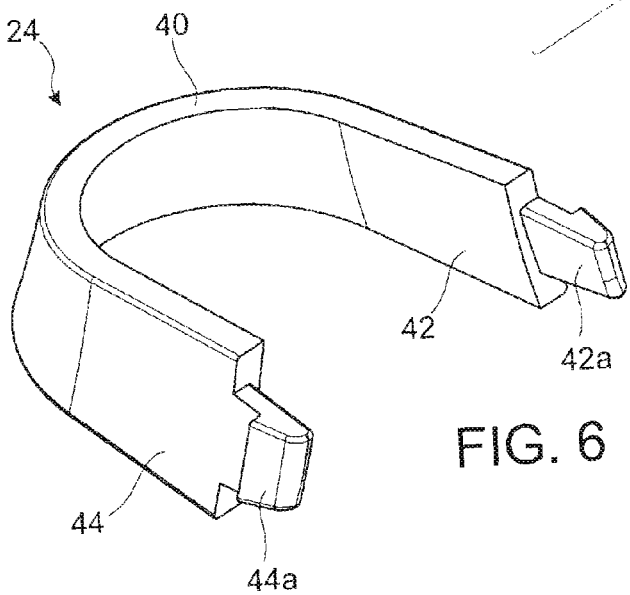
FIG. 6 is a perspective view of the strap of the tag housing assembly of FIG. 3.
Figure 7:
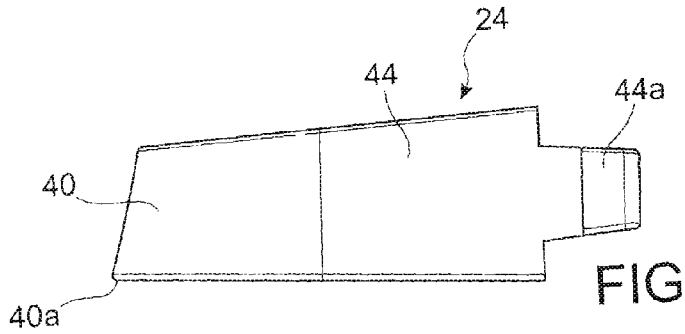
FIG. 7 is a side view of the strap of FIG. 6.

Referring to now to FIGS. 6 and 7, strap 24 is shown. Strap 24 is a generally U-shaped member having an arcuate base 40 and a pair of extending arms 42 and 44. The distal ends of the arms 42 and 44 include insertable latches 42*a* and 44*a*. The latches are designed for one way snap fit accommodation in recesses 30*a* and 30*b* formed in housing base 30.

One feature of the present invention is that the arcuate base 40 of strap 24 is tapered as shown in the side view of FIG. 7. This taper allows the strap to be tightly supported against the tapered bottle neck 12 as shown in FIGS. 1 and 2. The bottom portion 40*a* of the arcuate base 40 extends at an outward angle so as to accommodate the outward taper of the bottle neck. It is contemplated that the strap 24 may be specifically constructed to match any bottle neck to which the housing assembly is attached. Thus, a single housing 22 can be used for any bottle and a specifically constructed strap can be selectively coupled thereto for each bottle to which a tag is desired to be attached. By conforming the strap to the bottle neck, the housing assembly 10 can be secured against the neck. This helps prevent unauthorized detachment of the housing assembly from the bottle.

Referring now to FIGS. 1 and 4, the assembly of the components is shown. The tag 16 is secured in housing base 30 and cover 32 is secured thereto. The housing 22 and the strap 24 can be fitted around the bottle neck as shown in FIG. 1. Thereafter, the latches 42*a* and 44*a* of strap 24 can be inserted into recesses or catches 30*a* and 30*b* formed in the base 30. This snaps the strap into the base preventing nondestructive removal therefrom. As the cover 32 is secured to the base, access to the latches is prevented. The housing 22 and thus the tag 16 cannot be removed without destroying the housing assembly 10 while the cap is in place.

Moreover, the housing assembly is prevented from being removed from the neck of the bottle by the cap 20. The tight coupling of the strap against the bottle neck prevents the housing assembly from being moved upwards. As shown in FIG. 4, when the strap and the housing are secured together, they form an annular structure. The diameter of this structure is less than the diameter of the bottle cap 13, thereby preventing the housing assembly from being removed from the bottle without first removing the cap. Once the consumer purchases the bottle and removes the cap, the housing assembly may be removed and discarded.

Figure 8:
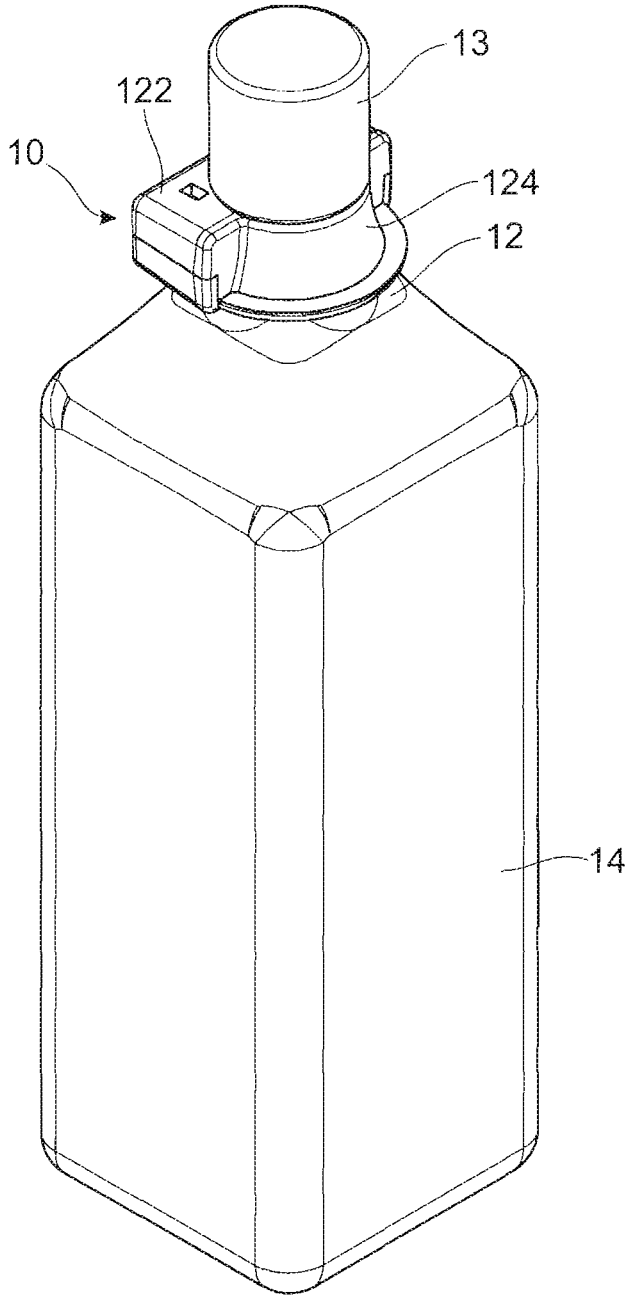
FIG. 8 is a perspective view of a further embodiment of the tag housing assembly of the present invention attached to the extending neck of a bottle.

Referring now to FIG. 8 a further embodiment of the tag housing assembly of the present invention is shown. The tag housing assembly of the present embodiment is substantially similar to the tag housing assembly shown above. Accordingly, similar reference numerals will be used to denote similar structure.

Tag housing assembly 110 may be supported on the neck 12 of a bottle 14. This embodiment of the tag housing assembly 110 includes a housing 122 and a strap 124 which is attachable to the housing 122 about the elongate neck 12 of bottle 14.

Figure 11:
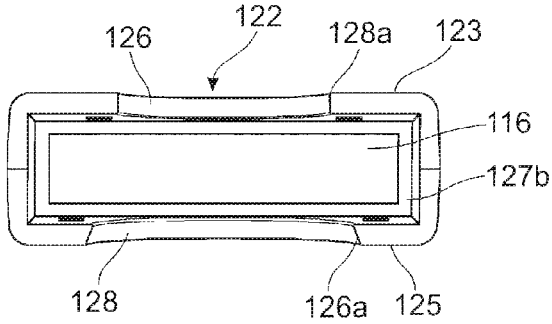
FIGS. 11 and 12 show respectively front plan and perspective views of the housing of FIG. 8.
Figure 12:
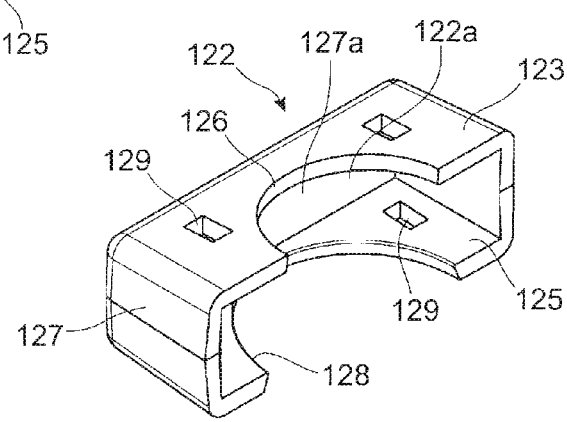

As shown in FIGS. 11 and 12, the housing 122 of housing assembly 110 is designed to support an electronic tag 116 therein. The tag 116 may be secured in any conventional fashion within the cavity 122*a* of housing 122. The housing 122 includes upper and lower spaced apart planar surfaces 123 and 125 and a partial perimetrical wall 127 extending therebetween. An elongate portion 127*a* of perimetrical wall 127 may be used to support tag 116 at an inside surface 127*b* thereof.

The spaced apart planar surfaces 123 and 125 include arcuate cutouts 126 and 128, respectively, which define a semi-circular neck engagement portion for engagement with the neck 12 of bottle 14. The planar surfaces 123 and 125 further include recesses 129 which are designed for accommodating latches of strap 124 as will be described in further detail hereinbelow.

Figure 9:
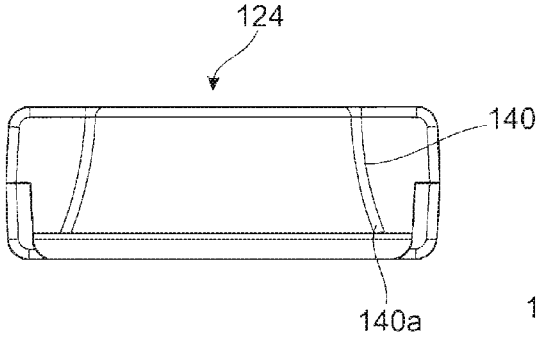
FIGS. 9 and 10 show respectively front plan and perspective views of the strap of FIG. 8.
Figure 10:
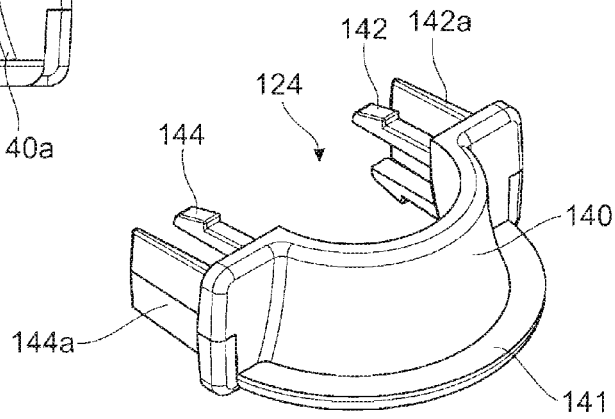

Referring now to FIGS. 9 and 10, strap 124 is shown. Strap 124 is generally a U-shaped member having generally a semi-circular arcuate wall 140. The arcuate wall 140 includes an extending planar rim 141 at a lower end thereof. Rim 141 provides structural stability and strength to the strap 124.

Strap 124 further includes a pair of extending latch arms 142 and 144. The latch arms are deflectable so as to provide one way snap fit accommodation within recesses 129 of housing 122. Adjacent the latch arms 142 and 144 are extending fingers 142*a* and 144*a*. The fingers help guide strap into connection with housing 122.

A particular feature of the present embodiment of the present invention is that the arcuate wall 140 of strap 124 is tapered as shown in FIG. 9. This taper forms a bearing surface allowing the strap to be tightly supported against the tapered bottle neck 12 as shown in FIG. 8. The bottom portion 140*a* of the arcuate wall 140 is curved or tapered outwardly so as to accommodate the outward taper of the bottle neck.

In addition, as particularly shown in FIG. 11, the walls 126 and 128 of housing 122 are also tapered. As shown in FIG. 11, each of arcuate walls 126 and 128 have an outward taper, which is similar to the taper of strap 124 and forms a bearing surface which allows the housing to be tightly supported against the tapered bottle neck 12. The bottom portion 126*a* and 128*a* of each of the walls 126 and 128 extends outwardly at an angle so as to accommodate the outward tapered of the bottle neck.

Thus, when assembled around the bottle neck, the tag housing assembly 110, including one or both of the bearing surfaces of housing 122 and strap 124, conforms to the configuration of the bottle neck and helps prevent unauthorized detachment of the housing assembly from the bottle. With the tag 116 secured within housing 122 and the strap 124 connected to the housing 122 around the bottle neck, the security tag 116 cannot be removed from the bottle with the cap in place without destroying the tag housing assembly. The annular surface formed by the housing 122 and strap 124 has a diameter less than the diameter of cap 13 so that it cannot be lifted past the bottle cap 13.

Once the consumer purchases the bottle and removes the cap 13, the housing assembly may be removed and discarded.

Various changes to the foregoing described and shown structures would now be evident to those skilled in the art. Accordingly, the particularly disclosed scope of the invention is set forth in the following claims.

What is claimed is:

1. A housing assembly for supporting an electronic tag to an extending neck of a bottle comprising:
   - a housing for accommodating said electronic tag, said housing having a bearing housing surface for engagement with said neck of said bottle;
   - a strap lockingly coupled to said housing about said bottle neck;
   - said strap having a continuous arcuate wall defining a bearing strap surface for engagement with said extended neck at least one of said bearing surfaces being tapered to generally match the taper of the extending neck of said bottle.

2. A housing assembly of claim 1 wherein said housing includes a base and a cover and where said tag is supported between said base and said cover.

3. A housing assembly of claim 2 wherein said cover is secured to said base preventing non-destructible access to said tag.

4. A housing assembly of claim 3 wherein said cover is ultrasonically welded to said base.

5. A housing assembly of claim 2 wherein said housing includes a pair of spaced apart recesses and wherein said strap includes a pair of latches, wherein said latches are insertable into said recesses preventing non-destructive removal of said latches therefrom.

6. A housing assembly of claim 5 wherein said strap is attachable to said housing in a manner wherein said strap is secured against said neck of said bottle.

7. A housing assembly of claim 1 wherein said arcuate wall of said strap is tapered so as to define said at least one tapered bearing surface.

8. A housing assembly of claim 1 wherein said housing includes a pair of spaced apart planar surfaces each planar surface having an arcuate cut out which defines said bearing housing surface.

9. A housing assembly of claim 8 wherein said arcuate cut out is tapered so as to define said at least one tapered bearing surface.

10. A housing assembly of claim 1 wherein said bearing strap surface and said bearing housing surface are both tapered.

11. An assembly comprising:

a bottle having an elongate extending bottle neck and cap removably attached at the distal end thereof;

a tag housing supporting an electronic tag;

a strap lockingly coupled to said housing about said bottle;

said housing having an arcuate bearing housing surface positioned against said extending neck and said strap having a continuous arcuate bearing strap surface positioned against said neck wherein at least one of said bearing surfaces includes a taper which generally matches the taper of the extending neck so as to prevent removal of said strap and said housing from said bottle.

12. An assembly of claim 11 wherein said housing and said strap defines an annular structure having a diameter less than the diameter of said bottle cap.

13. An assembly of claim 11 wherein said strap is coupled to said housing in a manner wherein said strap is secured against said neck of said bottle.

14. An assembly of claim 1 wherein said bearing housing surface includes said taper.

15. An assembly of claim 1 wherein said bearing strap surface includes said taper.

16. An assembly of claim 1 wherein said bearing housing surface and said bearing strap surface include said taper.

* * * * *